US005522570A

United States Patent [19]

Benenowski et al.

[11] Patent Number: 5,522,570

[45] Date of Patent: Jun. 4, 1996

[54] RAIL SECTION

[75] Inventors: Sebastian Benenowski; Hubertus Höhne, Both of Butzbach; Alfred Kais, Lich-Eberstadt; Erich Nuding, Aalen all of Germany

[73] Assignee: BWG Butzbacher Weichenbau GmbH, Butzbach, Germany

[21] Appl. No.: 367,317

[22] PCT Filed: Jul. 16, 1993

[86] PCT No.: PCT/EP93/01870

§ 371 Date: Apr. 11, 1995

§ 102(e) Date: Apr. 11, 1995

[87] PCT Pub. No.: WO94/02683

PCT Pub. Date: Feb. 3, 1994

[30] Foreign Application Priority Data

Jul. 22, 1992 [DE] Germany ..... 42 24 156.1

[51] Int. Cl.[6] ..... E01B 7/00

[52] U.S. Cl. ..... 246/463; 246/470

[58] Field of Search ..... 246/427, 454, 246/456, 455, 457, 458, 462, 463, 468, 470, 472

[56] References Cited

U.S. PATENT DOCUMENTS

| | | | |
|---|---|---|---|
| 747,955 | 12/1903 | Entwisle | 246/463 |
| 834,278 | 10/1906 | Entwisle | 246/463 |
| 872,473 | 12/1907 | Strong | 246/462 |
| 902,589 | 11/1908 | Lucas | 246/455 |
| 1,247,879 | 11/1917 | Reed et al. | 246/463 |

FOREIGN PATENT DOCUMENTS

| | | |
|---|---|---|
| 2318419 | 4/1974 | Germany . |
| 548749 | 3/1992 | Germany . |
| 1606565 | 1/1986 | U.S.S.R. . |

*Primary Examiner*—Mark T. Le

*Attorney, Agent, or Firm*—Dennison, Meserole, Pollack & Scheiner

[57] ABSTRACT

Rail construction including laterally adjacent frog sections with guard rails outwardly spaced to each side thereof by interposed liners. The components are interconnected by a transverse tightened bolt with vertical misalignment precluded by either nesting projections on adjacent abutting faces of the components or by a rigid, preformed sleeve press-fit within the bore receiving the bolt, the sleeve extending through the frog sections and at least partially through the liners.

20 Claims, 2 Drawing Sheets

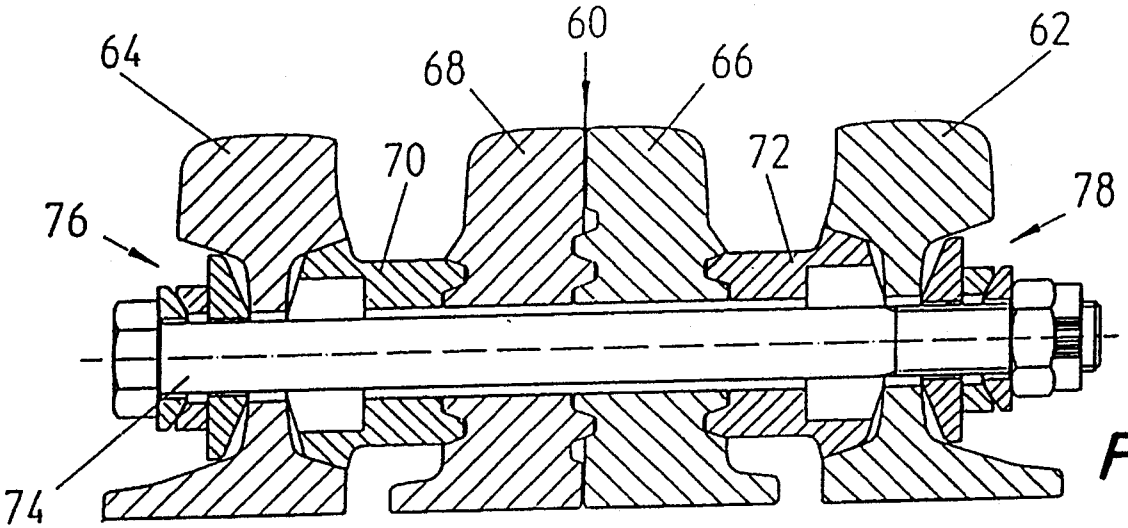
FIG. 2
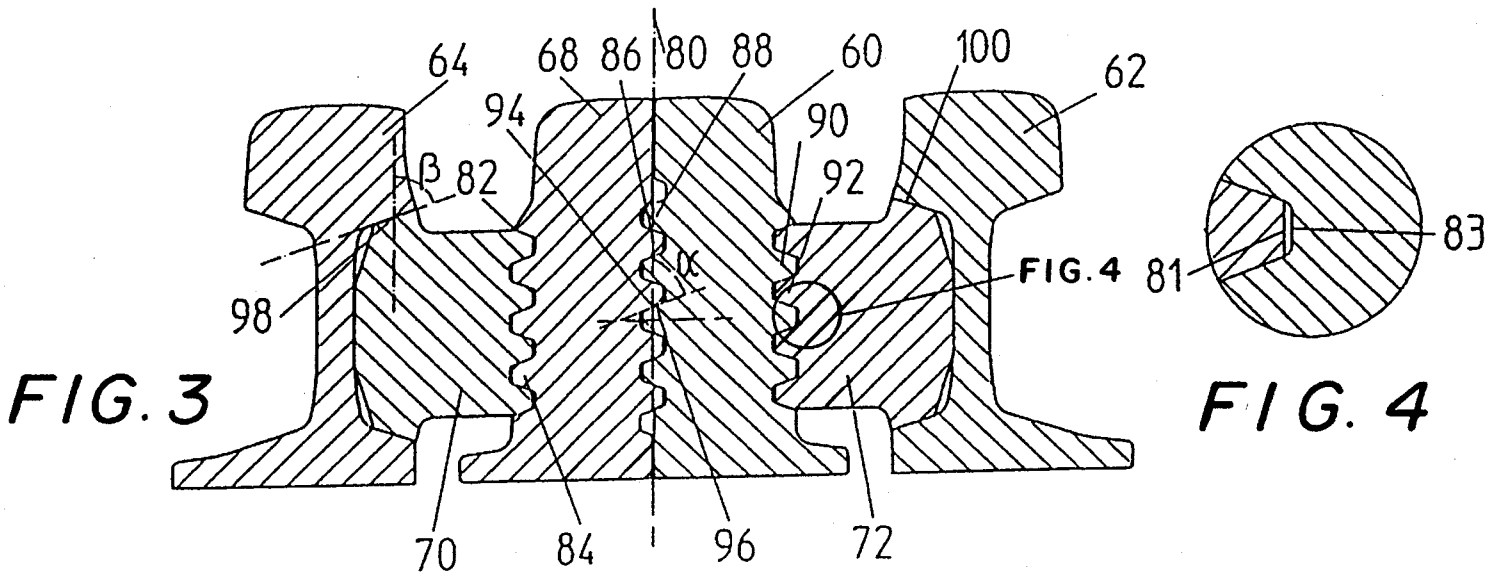
FIG. 3
FIG. 4

RAIL SECTION

BACKGROUND OF THE INVENTION

The invention relates to a rail section in the form of a frog comprising two rail sections and guard rails held apart by liners, where at least the frog is passed through by a sleeve surrounding a connecting element such as a bolt.

Frogs are provided at points or crossovers by intersections of rail tracks. There are single, double and triple frogs, although the single frog is most frequently found in simple points.

In the frog, the guiding surfaces of the intersecting rail tracks are interrupted. The rail tracks continuing on from the tongues are angled in the vicinity of the frog and are called guard rails. The two tracks continuing from the ends of the points converge towards the frog tip. The tip can comprise either normal rails (rail frog), specially constructed rails that are then partially welded (partial block frog), or made in one piece (block frog). The latter are used only rarely by the German Railways (DB).

In the case of frogs made flora rails, these latter are frequently welded. This can however result in drawbacks when hard-to-weld materials are to be connected. A further drawback is that extraneous material is present in the abutting surface. Surface decarburizations are also a drawback. Furthermore, the risk of cracking increases.

If the rail parts are not welded to one another, they are held together by connecting elements such as bolts. The drawback here however is that a relative movement between the rail parts takes place.

Various designs of frogs are shown in DE 548 749, DE 23 18 419, DE 81 05 454 U1 or DD 60 326.

SUMMARY OF THE INVENTION

The object underlying the present invention is to develop a frog of the type described at the outset such that rail parts connected to one another without welding cannot move relative to one another at least vertically to the longitudinal axis of the rail section.

The problem is substantially solved in accordance with the invention in that on the one hand in that the frog comprises unwelded rail sections and in that the sleeve passes without play through the rail sections and at least in some areas the liners are passed through free of play by the sleeve. The problem is further solved in that the frog comprises unwelded frog sections, and in that on the one hand said frog sections and on the other hand the liners arranged on both sides thereof holding apart the associated guard rails positively engage with one another by profiling provided in the longitudinal direction of the frog, said profiling comprising a serration formed by teeth extending from surfaces of the frog sections and the liners in contact with one another and being in play-free contact with their tooth flanks.

By the teachings in accordance with the invention, it is ensured by simple means that a relative movement vertical to the longitudinal axis cannot occur between the rail parts to be connected without welding being necessary in this connection area, in particular in the frog area passed through by the connecting element. In consequence, neither problems with surface decarburizations or crack formation nor problems from the presence of extraneous materials occur in the abutting surfaces. Also, the provision of such frog areas is less expensive.

Unwelded in this case means that in the connection area between guard rails and frog, i.e. in the area in which these elements are connected via the liners by means of a connecting element, the frog sections are not welded to one another. This does not however rule out that the tip, on the tongue side, or the normal rails, on the points end side, are welded on.

When the sleeve disposed without play is used, which rules out relative movement in any direction, this sleeve can be pressed or shrunk into the rail parts or liners.

It is thus possible for the frog sections and liners to be heated so that the sleeve can then be inserted. After cooling, the sleeve is pressed in, thereby ensuring the required absence of play.

Alternatively, it is also for example possible to cool the sleeve, so that it can then be inserted into the associated recesses of the frog sections and liners.

It is furthermore possible for the sleeve to be inserted into the frog sections in the cooled state and for heated liners to be shrunk onto the sleeve after their connection free of play.

A further development of a rail section that is inventive per se in the form of a frog area, where the guard rails each have a guard rail head with guide surfaces facing the frog for a wheel passing the frog area, is characterized in that the respective guide surfaces of the guard rails have a curvature matching the curvature of a wheel passing the frog. A constant curvature difference or a continually changing curvature difference—viewed in a plane vertical to the longitudinal direction of the rail parts—can pertain in relation to the respective contact surface between wheel and guide surface.

The bar-like or block-like liners of known form are preferably composed of a block-like inner section extending from the frog and passed through by the sleeve preferably completely without play, of a first wedge-shaped section of trapezoidal cross-section tapering out in the direction of the guard rails, and of a second wedge-shaped section likewise of trapezoidal cross-section underneath the guard rail head and supporting the latter. The first wedge-shaped section can have on the guard rail head side an outer surface that smoothly merges into the guide surface. In particular, the corresponding outer surface of the first wedge-shaped section can have a curvature that has the characteristics of the guide surface.

Further details, advantages and features of the invention are clear not only from the claims and from the features they describe, singly and/or in combination, but also from the following description of a preferred embodiment shown in the drawing.

BRIEF DESCRIPTION OF THE DRAWINGS

FIG. 2 shows a section through a second embodiment of a frog area,

FIG. 3 shows a further section through the frog in accordance with the second embodiment according to FIG. 2, and FIG. 4 shows an enlarged detail of the area indicated in FIG. 3.

DESCRIPTION OF PREFERRED EMBODIMENTS

Figure 1:
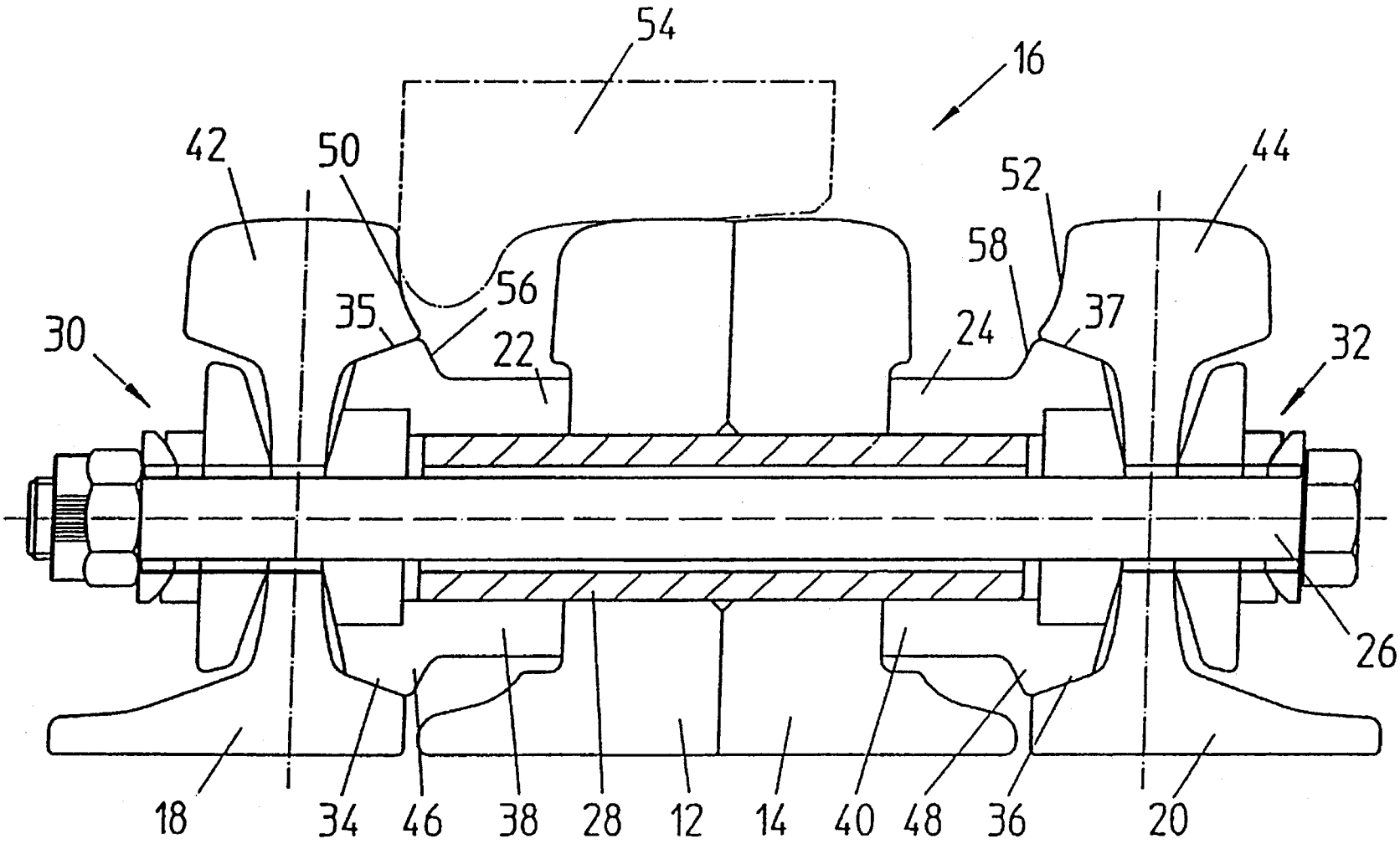
FIG. 1 shows a section through a first embodiment of a frog area.

FIG. 1 shows a section through a frog area that comprises a frog (16) comprising two rail sections (12) and (14) and guard rails (18) and (20) running along said frog. The rail sections (12) and (14) can be made of filled-section rails.

To hold the guard rails (18) and (20) apart front the frog (16), i.e. from the facing rail sections (12) and (14), liners (22) and (24) of generally known geometry are provided.

The connections between the guard rails (18) and (20) and the liners (22) and (24), and between the liners (22) and (24) and the rail sections (12) and (14) and their connections with one another are without welding, without however any relative movement being possible between them. This is achieved by a connecting element such as a bolt (26) passing through the unit described above in order to achieve a non-positive or partially positive connection, where a sleeve (28), inside which the bolt (26) extends, passes without play through the liners (22) and (24) partially, and through the rail sections (12) and (14) of the frog (16) completely. The bolt is tightened using intermediate pieces (30) and (32) on the outer web faces of the guard rails (18) and (20), thereby ensuring the required non-positive connection between the guard rails (18), the liners (22) and (24), and the frog (16).

As a result of the fact that the sleeve (28) passes without play through the rail sections (12) and (14) and at least in some areas through the liners (22) and (24), a relative movement between the latter and hence in relation to the guard rails (18) and (20) is ruled out. The latter effect is achieved by the liners (22) and (24), that each have an outer wedge-shaped section (34) and (36) respectively of trapezoidal shape, that match the geometry of the fishplate seating—not described in detail—of the associated guard rails (18) and (20) such that any relative movement is ruled out.

The liners (22) and (24) are each composed of a internal block-like section (38) or (40) resting against the outer web face of the rail section (12) or (24) respectively, of an adjacent first wedge-shaped section (46) or (48) extending in the direction of the guard rail heads (42) or (44) respectively, and the second wedge-shaped section (34) or (36) matching the fishplates of the guard rail (18) or (20) and supporting the guard rail head (42) or (44) in a common plane (35) or (37) respectively.

The sleeve (28) runs without play inside the block-like sections (38) and (40).

A particularly noteworthy feature is that the guard rail heads (42) and (44) have guide surfaces (50) and (52) respectively that each have a curvature matching that of the wheels (54) passing through the frog. A constant curvature difference can apply in the contact surface between the guide surface (50) or (52) and the wheel, or a continually changing curvature difference on succeeding sections, each viewed in a plane vertical to the frog's longitudinal axis. The facing outer surfaces (56) and (58) of the inner wedge-shaped sections (46) and (48) of trapezoidal shape extend in matched form over the guide surfaces (50) and (52).

The fact that the guard rail heads (42) and (44) are supported on their undersides by the second wedge-shaped sections (34) and (36) largely over their full width in the common plane (35) and (37) results in a greater support surface compared with the prior art, and thereby in an increase in the stability of the frog area.

The materials used for the rail sections (12) and (14), the liners (22) and (24) and the sleeve (28) should have equal or almost equal expansion coefficients.

FIGS. 2 and 3 show a further embodiment of a frog area in which the frog (60) associated with the guard rails (62) and (64) comprises two rail sections (66) and (68) not welded together and preferably made from filled-section rails.

Liners (70) and (72) are disposed between the guard rails (62) and (64) and the frog (60) in accordance with FIG. 1. The unit thus formed of guard rails (62) and (64), liners (70) and (72) and frog (60) is passed through with play by a bolt (74) that is tightenable from the outside by intermediate pieces (76) and (78) at the outer web surfaces of the guard rails (62) and (64), in order to achieve the required non-positive connection.

To rule out that the parts forming the frog, in particular the rail sections (66) and (68) of the frog (60) can move relative to one another in the direction of the central axis (80), the contacting surfaces of the rail sections (66) and (68), or the surfaces contacting them of the liners (70) and (72), are profiled. This profiling is formed by teeth extending from the contacting surfaces and running in the direction of the frog, only one of such teeth being shown in each surface and numbered (82), (84), (86), (88), (90) and (92). The respective teeth are shaped here such that tooth flanks of engaging teeth are aligned on one another without play, whereas the associated tooth head (81) and tooth foot (83) are kept separate from one another by teeth extending from opposite surfaces (see also enlarged section in FIG. 3).

Furthermore, the flanks, two of whom in contact with one another are numbered (94) and (96) as examples, describe in relation to the central axis (80) an angle $\alpha$ that is preferably between 65° and 75°, in particular 70°.

In this way, the required positive connection is achievable when the bolt (74) is tightened, so that a relative movement in the direction of the central axis (80) is ruled out. Suitable geometries naturally also apply for the teeth (82), (84) or (90), (92) running between the liners (70) or (72) respectively and the frog (60).

With regard to the rail heads of the guard rails (62) and (64) and to the design of the guide surfaces and geometry of the liners (70) and (72) matching them, reference is made to the embodiment in FIG. 1, with no further explanation being necessary.

It should however further be mentioned that the common planes of the liners (70) or (72) and the guard rail head undersides numbered (98) or (100) respectively describe in relation to the central axis (80) an angle $\beta$ that is also preferably between 65° and 75°, in particular 70°.

It must also be noted that the sleeve in FIGS. 2 and 3 is not an essential element.

We claim:

1. Rail construction including a frog comprising two laterally positioned, elongate rail sections with first, laterally adjacent, abutting faces, one on each said rail section, guard rails laterally outward of said rail sections to opposed sides of said frog, a liner interposed between and engaged with each said guard rail and a corresponding said rail section for maintaining the laterally outward position of said guard rails, each said liner and the corresponding rail section having second abutting faces thereon, each of said first and second abutting faces having spaced projections thereon, said projections on each said abutting face inter-nesting with the projections on a corresponding said abutting face, and weld-free connecting means clamping said guard rails, liners and frog rail sections together with said projections nested wherein lateral separation is precluded by a bolt, and transverse movement of said rail sections relative to each other and to said liners is prevented by said inter-nesting projections.

2. The rail construction of claim 1 wherein said projections comprise teeth with each said tooth having a free outer end and outwardly tapering opposed sides, each said tooth having the opposed sides thereof in intimate contact with adjacent sides of the teeth nesting therewith.

3. The rail section of claim 2 wherein the inter-nested teeth, in each instance, define a space outward of each outer tooth end wherein engagement of said inter-nested teeth is solely between the sides thereof.

4. The rail construction of claim 2 wherein each of said opposed sides of each said tooth extends at an angle of between approximately 65 degrees and 75 degrees to a corresponding said abutting face.

5. The rail construction of claim 4 wherein each of said guard rails has an upper guard rail head extending therealong, each said guard rail head having a guide surface thereon laterally inwardly directed toward said rail sections, each said guide surface having a curvature therein to conform to the curvature of a wheel passing therealong.

6. The rail construction of claim 5 wherein each said liner engages under the rail head of a corresponding said guard rail at an upward and inward inclination of approximately between 65 degrees and 75 degrees to the guard rail.

7. The rail construction of claim 5 wherein the curvature of each said guard rail head guide surface is continuously varied.

8. The rail construction of claim 7 wherein each said liner includes a block-like inner section extending from said frog, and an outer laterally enlarged section underlying and supporting the guard rail head of a corresponding said guard rail.

9. The rail construction of claim 8 wherein the outer section of each said liner includes a first surface thereon merging into and providing a general continuation of the guide surface of the rail head of a corresponding said guard rail.

10. The rail construction of claim 9 wherein said first surface of the outer section of each said liner has a curvature conforming to that of a corresponding said guide surface.

11. Rail construction including a frog comprising two laterally abutting, unwelded rail sections, guard rails laterally outward to opposite sides of said frog, a liner interposed between and engaged in a weld-free manner with each guard rail and a corresponding said side of the frog, a laterally extending bore defined through said rail sections, said liners and said guard rails, a preformed, rigid, elongate sleeve extending within said bore through and in intimate fixed engagement without play with said rail said sections and at least a substantial portion of each of said liners immediately adjacent said rail sections, said sleeve having ends terminated in the bore at said liners, wherein transverse movement of said rail sections and said liners, relative to said bore and said sleeve, is precluded, a connecting bolt engaged through said sleeve and bore, and tightening means beyond said guard rails for tensioning said bolt between said guard rails for a weld-free joining of said rail sections, liners and guard rails.

12. The rail construction of claim 11 wherein said sleeve is press-fit in said rail sections and said liners.

13. The rail construction of claim 12 wherein each of said guard rails has an upper guard rail head extending therealong, each said guard rail head having a guide surface thereon laterally inwardly directed toward said rail sections, each said guide surface having a curvature therein to conform to the curvature of a wheel passing therealong.

14. The rail construction of claim 13 wherein each said liner engages under the rail head of a corresponding said guard rail at an upward and inward inclination of approximately between 65 degrees and 75 degrees to the guard rail.

15. The rail construction of claim 14 wherein the curvature of each said guard rail head guide surface is continuously varied.

16. The rail construction of claim 15 wherein each said liner includes a block-like inner section extending from said frog, and an outer laterally enlarged section underlying and supporting the guard rail head of a corresponding said guard rail.

17. The rail construction of claim 16 wherein the outer section of each said liner includes a first surface thereon merging into and providing a general continuation of the guide surface of the rail head of the corresponding guard rail.

18. The rail construction of claim 17 wherein said first surface of the outer section of each said liner has a curvature conforming to that of a corresponding said guide surface.

19. The rail construction of claim 12 wherein each said liner includes a block-like inner section engaged with and extending from said frog, and an outer laterally enlarged section underlying and supporting a guard rail head of a corresponding said guard rail.

20. The rail construction of claim 19 wherein a outer section of each said liner includes a first surface thereon merging into and providing a general continuation of a guide surface of the rail head of the corresponding guard rail.

* * * * *

UNITED STATES PATENT AND TRADEMARK OFFICE

CERTIFICATE OF CORRECTION

PATENT NO. : 5,522,570

DATED : June 4, 1996

INVENTOR(S) : Sebastian BENENOWSKI et al

It is certified that error appears in the above-indentified patent and that said Letters Patent is hereby corrected as shown below:

Column 1, line 22, "flora" should be --from--.

Column 6, line 21, "14" should be --13--.

Signed and Sealed this

Fifteenth Day of October, 1996

Bruce Lehman

*Attest:*

BRUCE LEHMAN

*Attesting Officer*

*Commissioner of Patents and Trademarks*